United States Patent [19]

Bernhardt et al.

[11] Patent Number: 4,697,311

[45] Date of Patent: Oct. 6, 1987

[54] APPARATUS FOR THE MANUFACTURE OF A NONWOVEN FABRIC

[76] Inventors: Siegfried Bernhardt, Taklerstr. 15, 2820 Bremen 71; Hans Schmidgen, Korbweide 15, 2820 Bremen 70, both of Fed. Rep. of Germany

[21] Appl. No.: 893,653

[22] Filed: Aug. 6, 1986

[30] Foreign Application Priority Data

Aug. 6, 1985 [DE] Fed. Rep. of Germany ..... 3528140

[51] Int. Cl.[4] ..... D04H 11/04

[52] U.S. Cl. ..... 19/161.1; 19/163; 19/296

[58] Field of Search ..... 19/161.1, 163, 296

[56] References Cited

U.S. PATENT DOCUMENTS 4,553,289 11/1985 Strobh ..... 19/161.1

*Primary Examiner*—Louis K. Rimrodt

*Attorney, Agent, or Firm*—Hill, Van Santen, Steadman & Simpson

[57] ABSTRACT

Apparatus for the manufacture of a nonwoven fabric or the like whose width exceeds the working width of a carder or the like equipped with a plurality of take-down devices, deflection arrangement connecting thereto, and with a pile transport table, characterized by a stationary bottom table arranged between the respective take-down device and the respective deflection device, this bottom table extending over the full width of the nonwoven fabric supplied from the respective take-down device and a conveyor belt which moves in take-down direction of the take-down device and which extends over the full width of the nonwoven fabric supplied by the respective take-down device being arranged above said bottom table at such a distance therefrom that its lower belt portion is in contact with the upperside of the nonwoven fabric lying on the bottom table and conveys this nonwoven fabric from the take-down device to the deflection device; and in that the contact surfaces of the bottom table on the one hand and of the conveyor belt on the other hand [contacting] the nonwoven fabric are fashioned such that the coefficient of friction between the nonwoven fabric and the contact surface of the bottom table is significantly lower than that between the nonwoven fabric and the contact surface of the conveyor belt.

6 Claims, 2 Drawing Figures

APPARATUS FOR THE MANUFACTURE OF A NONWOVEN FABRIC

Figure 1:
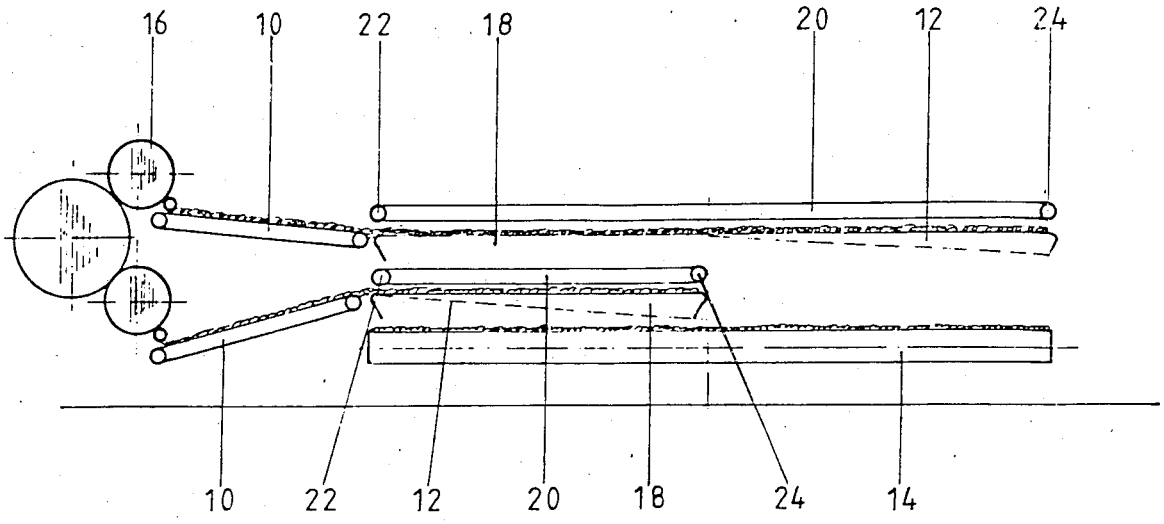

The invention relates to an apparatus for the manufacture of a nonwoven fabric or the like whose width exceeds the working width of a carder or the like equipped with a plurality of take-down devices, deflection arrangement connecting thereto, and with a pile transport table, whereby respectively one of at least two deflection devices follows upon every take-down device, said deflection devices—as seen in working direction of the carder or the like—being distanced from one another in accord with the width of the detached nonwoven fabric and being aligned at an angle relative to the working direction of the carder or the like which corresponds to half the angle between the work direction of the take-down device and that of the pile transport table, or respectively two deflection devices following upon at least one of the take-down devices, said deflection devices—as seen at a right angle to the work direction of the carder or the like—being distanced from one another in accord with the width of the detached nonwoven fabric or the like and being aligned at an angle of 45° relative to the work direction of the carder or the like and relative to the pile transport table which is parallel to the latter.

German Pat. No. 32 42 539 (U.S. Pat. No. 4,553,289) discloses an apparatus of the species set forth above which, by guiding the detached nonwoven fabric webs over the deflection devices such that the edges of the detached nonwoven fabric webs are aligned abutting directly against one another or slightly overlapping one another, makes it possible to produce a nonwoven fabric band whose width exceeds the working width of the employed carder, carding machine or the like, whereby, differing from, for example, the apparatus of the type disclosed in German OS No. 22 64 251, the pile weight is not increased and the take-down speed is not reduced in comparison to the inherently possible take-down speed of the carder or carding machine.

The apparatus set forth above, wherein the feed of the respective nonwoven fabric from the respective take-down device to the respective deflection device preferably ensues by means of a plurality of aprons proceeding in moving direction, has definitely proven itself on principle. However, a plurality of separate roller drives are required for the various aprons, these making the structure relatively complicated. By contrast, the employment of obliquely placed rollers for transporting the nonwoven fabric, as disclosed, for example, in German OS No. 22 64 251, in fact yielded a simplification in the apparatus of the species in comparison to the problems of the individual apron drive that have been mentioned but necessarily led to drawing phenomena which would disadvantageously influence the quality of the nonwoven fabric. The invention is therefore based on the object of improving the apparatus of the species such without deterioration of the quality of the nonwoven fabric that the transport of the nonwoven fabric from the respective take-down device to the respective deflection device can be more easily accomplished.

In an apparatus of the species, this object is achieved in accord with the invention by means of a respective stationary bottom table arranged between the respective take-down device and the respective deflection device, this bottom table extending over the full width of the nonwoven fabric supplied from the respective take-down device and a conveyor belt which moves in take-down direction of the take-down device and which extends over the full width of the non-woven fabric supplied by the respective take-down device being arranged above said bottom table at such a distance therefrom that its lower belt portion is in contact with the upperside of the nonwoven fabric lying on the bottom table and conveys this nonwoven fabric from the take-down device to the deflection device; and in that the contact surfaces of the bottom table on the one hand and of the conveyor belt on the other hand [contacting] the nonwoven fabric are fashioned such that the coefficient of friction between the nonwoven fabric and the contact surface of the bottom table is significantly lower than that between the nonwoven fabric and the contact surface of the conveyor belt.

A preferred embodiment of the invention provides that the bottom table is composed of highly polished sheet metal or the like.

Alternatively, it can also be provided that the conveyor belt is and endless belt of rubber or the like.

The invention also provides, when warranted, that the conveyor belt is an endless belt of a cloth material or the like.

It can also be provided in accord with the invention that the conveyor belt is height-adjustable relative to the bottom table.

A further embodiment of the invention is characterized in that the conveyor belt is conducted over at least two shafts arranged at a distance from one another, at least one of these shafts being driven.

In that, given the apparatus of the invention, the feed of the nonwoven fabric from the take-down device or, respectively, the take-down table to the respective deflection device ensues by means of the rigid bottom table whose surface is preferably composed of polished sheet metal or the like and by means of the endless belt or, respectively, endless cloth situated at a distance thereabove whose lower portion attacks in frictionally entraining fashion at that surface of the nonwoven fabric to be transported which faces away from the bottom table, whereby the airgap between the bottom table and the conveyor belt is adjustable just as are the coefficients of friction between the nonwoven fabric and the bottom table on the one hand and, on the other hand, between the nonwoven fabric and the conveyor belt, one succeeds in a surprisingly simple way that is easy to govern in design terms in guiding the nonwoven fabric from the take-down device to the deflection device without any drawing phenomenom or other disadvantageous influencing.

Figure 2:
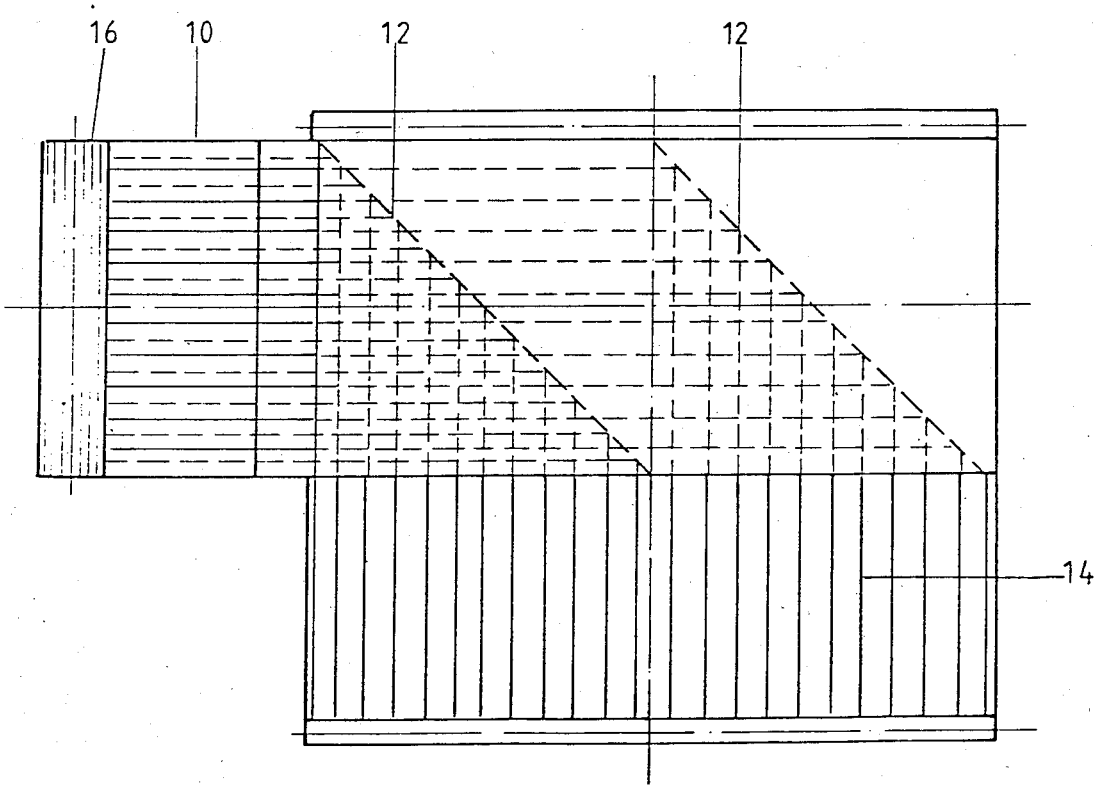

Further features and advantages of the invention derives from the following description in which an exemplary embodiment is set forth in detail with reference to the schematic drawing. Thereby shown are:

FIG. 1 an exemplary embodiment of an apparatus of the invention given take-down proceeding at right angles relative to the work direction of the machine, shown in plan view; and FIG. 2 a schematic illustration of a side view of the apparatus of FIG. 1.

As the drawing shows, a bottom table 10 composed in a known way of an endless belt of the like precedes a respective deflection device 12 therein from which the nonwoven fabric supplied from a carder 16 is conducted to a pile transport table 14. As the drawing shows, the transport of the nonwoven fabric from the take-down table 10 to the deflection device 12 ensues by means of a bottom table 18 extending over the full width of the nonwoven fabric which is rigidly arranged and is preferably composed of a highly polished sheet metal and by means of a conveyor belt 20 arranged above the bottom table 18 at an adjustable distance which is conducted over two shafts 22,24 of which one is a driven drive shaft. By means of an appropriate selection of the material for the bottom table 18 on the one hand and for the conveyor belt on the other hand or, respectively, by means of a corresponding fashioning of the respective contact surfaces facing the nonwoven fabric, the friction between the nonwoven fabric and the bottom table 18 is extremely low but is higher between the nonwoven fabric and the conveyor belt 20, so that the conveyor belt transports the nonwoven fabric across the bottom table in sliding fashion and supplies it to the deflection device.

As in the exemplary embodiment set forth with reference to FIGS. 1 and 2 of German Pat. No. 32 42 539, given the exemplary embodiment of the apparatus of the invention set forth herein, the nonwoven fabric coming from the carder 16 is supplied to the respective deflection device 12 across the respective take-down table 10 and the respective bottom table 18 with conveyor belt 20. The deflection devices 12 thereby proceed at an angle of 45° relative to the working direction of the carder 16, as a result whereof the belt of nonwoven fabric is deflected at an angle of 90° relative to the working direction of the carder 16. As a result of the arrangement of the deflection devices 12 at a mutual spacing which—as seen in working direction of the carder 16—corresponds to the width of a pile web, the two nonwoven fabric webs manufactured by the carder 16 come to lie next to one another on the pile transport table 14, so that a new belt of nonwoven fabric having twice the width arises.

For the rest, the described apparatus of the invention in accord with the exemplary embodiment shown herein operates just as the apparatus cited above, whereby, of course, the invention is also suitable in combination with the other exemplary embodiments of the apparatus of German Pat. No. 32 42 539, in particular given the exemplary embodiment of FIGS. 3 and 4 therein. In this regard, the specification of German Pat. No. 32 42 539 is referenced in full scope for further explanation.

The features of the invention disclosed in the above description, in the drawing and in the claims can be essential both individually as well as in arbitrary combinations for the realization of the invention in terms of the various embodiments thereof.

What is claimed is:

1. An apparatus for the manufacture of a nonwoven fabric whose width exceeds the working width of a carding device, comprising:

a plurality of take-down devices receiving the output of said carding device, a pair of spaced deflector means cooperating with said take-down devices, a stationary bottom table disposed between a take-down device and a deflector means, said bottom table extending over the full width of the nonwoven fabric supplied by said take down devices, and an endless conveyor belt spaced above said bottom table by a distance such that its lower belt portion is in contact with the upper side of a nonwoven fabric lying on said bottom table, said conveyor belt being positioned to convey the nonwoven fabric from a take-down device to a deflector means, the surface of said bottom table having a coefficient of friction with respect to said nonwoven fabric which is significantly lower than that between said nonwoven fabric and the lower belt portion of said conveyor belt.

2. Apparatus according to claim 1, characterized in that the bottom table (18) is composed of highly polished sheet metal.

3. Apparatus according to claim 1, characterized in that the conveyor belt (20) is an endless belt of rubber.

4. Apparatus according to claim 1, characterized in that the conveyor belt (20) is an endless belt of a cloth material.

5. Apparatus according to claim 1, characterized in that the conveyor belt (20) is height-adjustable relative to the bottom table (18).

6. Apparatus according to claim 1, characterized in that the conveyor belt (20) is conducted over at least two shafts arranged at a distance from one another, at least one of said shafts being driven.

* * * * *